US010323482B2

(12) United States Patent
Styler et al.

(10) Patent No.: US 10,323,482 B2
(45) Date of Patent: Jun. 18, 2019

(54) FLOW-ACTUATED PRESSURE EQUALIZATION VALVE AND METHOD OF USE

(71) Applicant: DRECO ENERGY SERVICES ULC, Calgary, Alberta (CA)

(72) Inventors: Graham Styler, Calgary (CA); Lewis Facca, Calgary (CA)

(73) Assignee: DRECO ENERGY SERVICES ULC, Calgary, AB (CA)

( * ) Notice: Subject to any disclaimer, the term of this patent is extended or adjusted under 35 U.S.C. 154(b) by 0 days.

(21) Appl. No.: 15/562,832

(22) PCT Filed: Mar. 31, 2015

(86) PCT No.: PCT/CA2015/050259
§ 371 (c)(1),
(2) Date: Sep. 28, 2017

(87) PCT Pub. No.: WO2016/154726
PCT Pub. Date: Oct. 6, 2016

(65) Prior Publication Data

US 2018/0106130 A1 Apr. 19, 2018

(51) Int. Cl.
*E21B 34/08* (2006.01)
*E21B 34/10* (2006.01)
(Continued)

(52) U.S. Cl.
CPC ..... *E21B 34/08* (2013.01); *E21B 33/1294* (2013.01); *E21B 34/10* (2013.01); *E21B 34/12* (2013.01)

(58) Field of Classification Search
CPC ..... E21B 34/08; E21B 34/10; E21B 34/12; E21B 33/1294
See application file for complete search history.

(56) References Cited

U.S. PATENT DOCUMENTS 5,020,592 A 6/1991 Muller et al.
6,474,419 B2 11/2002 Maier et al.
(Continued)

FOREIGN PATENT DOCUMENTS

CA 2683432 A1 12/2010
RU 2021490 C1 10/1994
(Continued)

OTHER PUBLICATIONS

International Patent Application No. PCT/CA2015/050259 International Search Report and Written Opinion dated Dec. 7, 2015 (7 pages).
(Continued)

*Primary Examiner* — D. Andrews
*Assistant Examiner* — Yanick A Akaragwe
(74) *Attorney, Agent, or Firm* — Conley Rose, P.C.

(57) ABSTRACT

A flow-actuated pressure equalization valve, for use with a downhole tool such as a treatment tool, for use in stimulating a subterranean formation. The equalization valve allows the pressure of treatment fluid above and below an isolation device to be equalized so the treatment tool can be moved. The valve can be closed when fluid flow exceeds a certain threshold and the treatment tool is set in the wellbore. While running in or pulling out of hole, the valve will not close regardless of the rate of fluid flow. The valve can be opened by stopping fluid flow and then bleeding off pressure above the isolation device, or by pulling up on the treatment tool.

20 Claims, 8 Drawing Sheets

(51) Int. Cl.
*E21B 34/12* (2006.01)
*E21B 33/129* (2006.01)

(56) References Cited

U.S. PATENT DOCUMENTS

| | | | |
|---|---|---|---|
| 6,666,273 | B2 | 12/2003 | Laurel |
| 8,141,642 | B2 | 3/2012 | Olstad et al. |
| 2004/0084190 | A1 | 5/2004 | Hill et al. |
| 2005/0150661 | A1 | 7/2005 | Kenison et al. |
| 2011/0198082 | A1 | 8/2011 | Stromquist et al. |
| 2012/0055671 | A1 | 3/2012 | Stromquist et al. |
| 2013/0133891 | A1 | 5/2013 | Getzlaf et al. |

FOREIGN PATENT DOCUMENTS

| | | | |
|---|---|---|---|
| RU | 2170331 | C2 | 10/2001 |
| RU | 2291279 | C2 | 10/2007 |
| SU | 1781416 | A1 | 12/1992 |
| WO | 2005/068769 | A2 | 7/2005 |
| WO | 2011/080498 | A1 | 7/2011 |

OTHER PUBLICATIONS

Russian Patent Application No. 2017133017 Official Action (Inquiry) of the Substantive Examination dated Aug. 1, 2018 (11 pages).

FLOW-ACTUATED PRESSURE EQUALIZATION VALVE AND METHOD OF USE

CROSS-REFERENCE TO RELATED APPLICATIONS

The present application is a National Phase entry of, and claims priority to, PCT Application No. PCT/CA2015/050259, filed Mar. 31, 2015, which is incorporated by reference herein in its entirety for all purposes.

STATEMENT REGARDING FEDERALLY SPONSORED RESEARCH OR DEVELOPMENT

Not applicable.

FIELD

The subject matter disclosed herein relates to an equalization valve for use in a downhole tool assembly, the valve being useful for the equalization of fluid pressures about the valve.

BACKGROUND

At various stages during the lifetime of a well, the wellbore will require that a particular operation requiring treatment by fluids, such as for example fracturing, cleaning or stimulation be performed. In performing a wellbore treatment or operation it is often desirable to deliver a fluid treatment to a particular wellbore region rather than to the entire wellbore. To this end, it is well known to use a downhole tool fit with one or more packers to selectively and sealingly engage a wellbore or a casing and isolate the region of the wellbore that is to be treated. The downhole tool is conveyed into and out of the well on a work string, such as coiled tubing.

A number of different types of packers are known (bridge plugs, friction cups, inflatable packers, and straddle packers) and they can be used to isolate a section of the wellbore below the packer or between a pair of packers, depending on the treatment operation to be performed.

Packers, by design, are a barrier to fluid movement, and yet the downhole tools bearing packers are intended to be moved up and down along the wellbore during run-in and when being pulled out of hole (POOH), and are alternately set and released, all of which occurs in a fluid environment. Thus, without fluid management about the packers or through the downhole tool, the operator can end up swabbing the well with possible detrimental effect to the wellbore or the downhole tool.

The downhole tools bearing packers are exposed to varying conditions during use, and debris accumulation around the tool assembly is also concern. Fluid flow during operations or movement can carry significant amounts of debris that settles over and about the sealing device, or within other portions of the tool assembly. This may result in tool damage, or in the tool assembly becoming lodged within the wellbore.

Further, once a particular treatment operation has been performed, it may be desirable to release the downhole tool and associated packers and move it to another location in the wellbore and set the tool again, or to remove it entirely from the wellbore. Generally, a pressure differential across the packer element will exist after an operation in the wellbore is performed, for example a fracturing operation. Unless dissipated or otherwise released, a fluid head uphole of the downhole tool imposes significant fluid forces on the tool and can maintain the packer in an energized state or hold other aspects of the downhole tool in a set condition, risking damage to the tool, the packers or the wellbore if forcibly moved, or preventing any movement at all.

In order to release the tool, the pressure above and below the packer should be equalized. Once the pressure is equalized, the work string can then be manipulated to unset the packer. Accordingly, equalization across a packer after a treatment or other operation has been performed is desirable to avoid debris-related tool malfunction, jamming or immobility of the tool assembly, and potential loss of the well if the tool assembly cannot be retrieved.

US 2011/0198082 teaches a tool assembly including a multi-function valve deployed on work string. Forward and reverse circulation pathways to an isolated interval of a wellbore allow clearing of debris from the wellbore annulus while the sealing device remains set against the well bore. The valve plug is actuable upon application of force to the work string.

US 2012/0055671 teaches a tool assembly deployed on work string. The tool assembly includes an equalization valve that can be opened or closed to control fluid passage between the coiled tubing and treatment zone to the wellbore below. The valve plug may be actuated from surface by pulling or pushing on the tubing to open or to seal the passageway upon application of mechanical pressure to the work string.

US2013/0133891 teaches an equalization valve having a valve plug movable from an open position to a seated position. The valve has a primary fluid passageway and the valve plug defines a conduit that provides for a minimal fluid flow across a sealing element, when the valve plug is at the seated position. The movement of the valve plug between the open position and the seated position is mediated by application of mechanical force applied to the work string.

U.S. Pat. No. 6,474,419 teaches a packer with an equalizing valve for automatically equalizing the pressure above and below the packer element. The packer comprises an equalization valve that has an open position and a closed position. The equalization valve seals to a closed position to prevent flow through the valve when the packer element is actuated to engage the wellbore. Communication above and below the packer is equalized by setting the valve to an open position, after which the packer can be unset and retrieved from the wellbore.

CA 2,683,432 teaches a pressure equalization valve for a work string comprising an equalization valve that closes when a fluid flow having a rate greater than a threshold actuates a shuttle to close the valve. A fluid flow rate less than the threshold maintains the shuttle biased in the open position to open the valve.

U.S. Pat. No. 6,666,273 teaches a plunger-type valve for use in a wellbore. The valve is arranged to be actuated by the differential pressure to selectively allow fluid flow to enter and exit the valve in both directions. The valve seat is biased for controlled flow in one direction and the plunger 704 is biased to enable controlled flow in a second direction. Subsequently, the plunger-type valve can be deactivated to selectively allow fluid flow in only one direction.

U.S. Pat. No. 8,141,642 teaches a valve assembly that is configured to selectively control fluid flow into a fill-up and circulation tool and out of the tool. The valve assembly comprises a movable valve head and a movable valve seat.

The valve seat is biased for controlled flow in one direction and the valve stem or head is biased to enable controlled flow in a second direction.

What is needed in the art is an equalization valve that can be moved up and down the wellbore and used in varying positions along the wellbore, without having to pull the valve up to the surface to reset it.

In equalization valves that are opened by bleeding pressure off the valve to equalize pressure above and below the valve, it can be difficult to ascertain from the surface whether the valve is in fact open and able to be moved without damaging the packers. Bleeding off is a particular problem in low pressure wells. In some cases the pressure reduction can allow fluid to flow back into the well, which can carry debris that damages the packers when they are moved. Thus, it would be beneficial to avoid using bleeding off as the primary means by which the valve is opened.

It may at times be necessary to flow fluid through the equalization valve in order to clean components of the work string that lie below the valve. Accordingly, valves actuated by fluid flow are at risk of premature actuation. Similarly, flow-induced closure of a valve can also arise when there is a relative movement of fluid through the valve while moving the tool along a fluid-filled wellbore, thus limiting tripping rates between zones.

SUMMARY OF DISCLOSURE

Described herein is a pressure equalization valve that is used to equalize pressure across a downhole tool. The valve requires actuation by two different mechanisms, and thus provides an added degree of control when the valve is moved within the wellbore and/or used in a treatment or stimulation. The valve has a fluid flow actuation aspect that can be enabled and disabled using manipulation of the relative axial positions of an uphole and a downhole portion of the downhole tool.

In one aspect, described herein is a pressure equalization valve comprising:

a downhole tubular telescopically coupled for axial movement relative to an uphole tubular and forming a contiguous axial bore therethrough, the downhole tubular delimited for axial movement towards the uphole tubular at an uphole-delimited position and away from the uphole tubular at a downhole-delimited position, a valve seat fit within the axial bore of the downhole tubular for defining an uphole valve bore and a downhole valve bore in fluid communication therethrough;

a valve shuttle disposed in the bore of the uphole tubular and axially movable therein, the shuttle biased uphole to an uphole-biased position, and being actuable towards a downhole-delimited position by fluid flow through the uphole valve bore; and the downhole tubular being actuable from the downhole-delimited position to a valve-enabled position, at which a valve ball on the shuttle engages the valve seat when fluid flow through the uphole valve bore is greater than a threshold flow rate; and wherein when the downhole tubular is in the valve-enabled position, fluid flow greater than the threshold flow rate overcomes the biasing to move the shuttle from the uphole-biased position to a flow-extended position at which the valve ball engages the valve seat to isolate the uphole valve bore from the downhole valve bore, and fluid flow less than the threshold flow rate maintains the shuttle biased in the uphole-biased position for continued fluid communication between the uphole valve bore and the downhole valve bore; and when the downhole tubular is not in the valve-enabled position, the valve ball is spaced from the valve seat so that when the shuttle is in the flow-actuated position the valve ball remains spaced from the valve seat for continued fluid communication between the uphole valve bore and the downhole valve bore.

In one embodiment the valve shuttle has a fluid inlet in fluid communication with the uphole valve bore, and a flow-diverting fluid outlet in fluid communication with the uphole valve bore, and fluid flow through the shuttle's fluid inlet and fluid outlet urges the shuttle downhole against resistance of the biasing.

In one embodiment the downhole tubular further comprises a means of immobilizing the downhole tubular in a wellbore.

In one embodiment the valve seat is fit at an end of the bore of the downhole tubular.

In one embodiment the downhole tubular moves axially within the bore of the uphole tubular.

In one embodiment the valve-enabled position of the downhole tubular is the uphole-delimited position of the downhole tubular.

In one embodiment the uphole biased position of the shuttle is an uphole-delimited position of the shuttle.

In another aspect described is a pressure equalization valve for a downhole tool, the valve comprising:

an uphole tubular and a downhole tubular telescopically coupled and forming a contiguous axial bore therethrough; the downhole tubular being actuable for axial movement towards the uphole tubular to a valve-enabled position and away from the uphole tubular to a valve-disabled position;

a valve seat fit within the axial bore of the downhole tubular for defining an uphole valve bore and a downhole valve bore in fluid communication therethrough; and a valve shuttle disposed in the bore of the uphole tubular and axially movable therein, the shuttle biased uphole to an uphole-biased position, and being actuable towards a flow-activated position by fluid flow that is greater than a threshold flow rate; and wherein, when the downhole tubular is in the valve-disabled position and the shuttle is in the flow-actuated position, the valve is open, for continued fluid communication between the uphole valve bore and the downhole valve bore;

when the downhole tubular is in the valve-enabled position and the shuttle is in the uphole-biased position, the valve is open, for continued fluid communication between the uphole valve bore and the downhole valve bore; and when the downhole tubular is in the valve-enabled position, and the shuttle is in the flow-actuated position, a valve ball on the shuttle engages the valve seat and the valve is closed to fluid communication between the uphole valve bore and the downhole valve bore.

In one embodiment fluid flow through the uphole valve bore and into the downhole valve bore urges the shuttle downhole against resistance of the biasing.

In one embodiment the fluid flow through the uphole valve bore comprises the flow of fluid into a fluid inlet of the valve shuttle that is in fluid communication with the uphole valve bore, and out of a fluid outlet that is in fluid communication with the uphole valve bore.

In one embodiment the downhole tubular further comprises a means of immobilizing 5 the downhole tubular in a wellbore.

In one embodiment the valve seat is fit at an end of the bore of the downhole tubular.

In one embodiment the downhole tubular moves axially within the bore of the uphole tubular.

In one embodiment the valve-enabled position of the downhole tubular is an uphole-delimited position of the downhole tubular.

In one embodiment the valve-disabled position of the downhole tubular is a downhole-delimited position of the downhole tubular.

In one embodiment the uphole biased position of the shuttle is an uphole-delimited position of the shuttle.

BRIEF DESCRIPTION OF THE DRAWINGS

FIG. 2A is a view with the downhole tubular at a valve-disabled position and the valve shuttle at an uphole-biased position, and the valve is in an open configuration;

FIG. 2B is a view with the downhole tubular in a valve-enabled position and the valve shuttle at an uphole-biased position, and the valve is in an open configuration; and FIG. 2C is a view with the downhole tubular in a valve-enabled position and the shuttle at a flow-extended position, and the valve is in a closed configuration.

FIG. 3A illustrating an instance when the valve is in an open configuration, with the downhole tubular in a valve-disabled position and the valve shuttle in an uphole-biased position;

FIG. 3B illustrating an instance when the valve is in an open configuration, with the downhole tubular in a valve-disabled position and the valve shuttle in a flow-extended position;

FIG. 3C illustrating an instance when the valve is an open configuration, with the downhole tubular in a valve-enabled position and the valve shuttle in an uphole-biased position; and FIG. 3D illustrating an instance when the valve is a closed configuration, with the downhole tubular in a valve-enabled position and the valve shuttle in a flow-extended position, to seat and close the valve.

FIGS. 4A and 4B show the valve seat of the downhole tubular at the downhole-delimited position, with the valve shuttle at its uphole- and downhole-delimited positions (A and B, respectively), in both cases the valve remaining open for equalization; and FIG. 4C shows the valve seat of the downhole tubular at its uphole-delimited position, with the valve shuttle at its uphole-delimited position, the valve remaining open for equalization; and FIG. 4D shows the downhole tubular at a valve-enabled position, with the valve shuttle at a flow-extended position, the valve being closed for treatment operations.

FIG. 5A illustrates the valve in an open configuration with the downhole tubular in a valve-enabled position;

FIG. 5B illustrates the valve in a closed configuration, as the valve shuttle is fluid-forced to a flow-extended position such that the valve ball engages the valve seat;

FIG. 5C illustrates the valve in a closed configuration, with the upper tubular pulled up an increment A while the valve shuttle remains fluid-forced closed, the valve shuttle shifting against the biasing;

FIG. 5D illustrates the valve in a closed configuration, with the upper tubular pulled up a further increment B while the valve shuttle remains fluid-forced closed, the valve shuttle shifting further against the biasing;

FIG. 5E illustrates the valve in an open configuration, with the upper tubular pulled up a further increment C, the valve shuttle bottoming out against the biasing, and lifting the ball from the valve seat to open and equalize across the valve; and FIG. 5F illustrates the valve in an open configuration, with maximum fluid flow downhole therethrough.

FIG. 6A is a flow chart illustrating the steps of operation that remain possible during run in when the valve is in a disabled and open configuration;

FIG. 6B is a flow chart illustrating the steps of operation for fluid treatment and tool release for repositioning, the valve being in an enabled configuration and closed for well treatment, and then subsequently disabled; and FIG. 6C is a flow chart illustrating the steps of operation that remain possible during pull out, while the valve is in a disabled and open configuration.

DETAILED DESCRIPTION OF DISCLOSED EXEMPLARY EMBODIMENTS

Figure 1A:
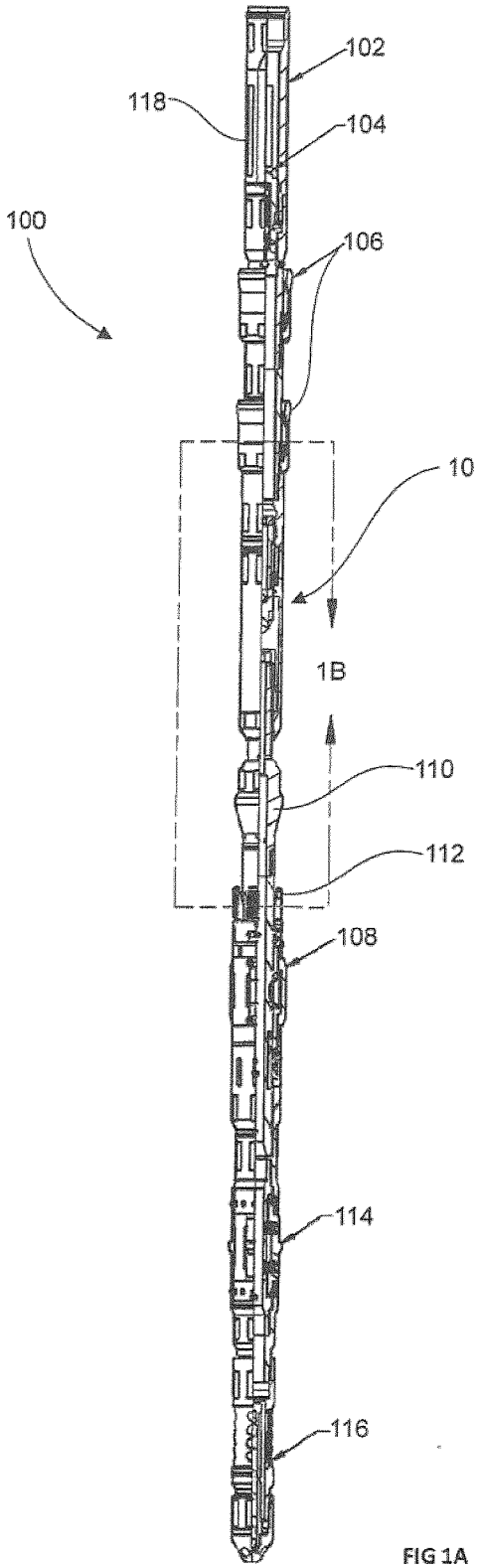
FIG. 1A is a side partial sectional view of a work string with an equalization valve according to one embodiment.

The downhole tool comprises an uphole tubular portion connected to the work string manipulated from surface and a downhole tubular portion releasably anchorable in the wellbore. The valve spans the uphole and downhole tubulars and telescopic manipulation therebetween either enables or disables the valve. A valve shuttle and ball are supported in the uphole tubular and a valve seat is supported in the downhole tubular. When in an "enabled configuration", the shuttle is actuable at a threshold fluid flow rate against biasing to close the valve. When in a "disabled configuration", the valve remains open regardless of fluid flow rate.

In order to close the valve two different events occur: (a) the downhole tubular is anchored in the wellbore and sets the position of the valve's valve seat, the uphole tubular being manipulated to place the valve shuttle's ball within the operable travel range of the valve seat, the valve being in an enabled configuration, and (b) the rate of fluid flow through the valve is manipulated to be greater than a threshold rate, to overcome the biasing and actuate the valve ball towards the valve seat. When the downhole tubular is not immobilized through anchoring in the well bore, the valve cannot be closed even if the rate of fluid flow through the valve exceeds the threshold rate, as the pressure from fluid flow through the valve will force the seat away from the range of travel of the valve shuttle and ball. Therefore, even if the rate of fluid flow through the valve exceeds the threshold rate, the valve will not close. This scenario is applied, for example, if it is desired to direct fluid downhole of the valve such as to wash therebelow or to clean up any internal components of the downhole tool. Further, the tool can be pulled out of hole at high tripping rates, resulting in high displaced fluid downhole therethrough, because there is no concern that the rate of fluid flow will close the valve.

After closing the valve, and performing a wellbore operation such as a fracing operation, the equalization valve can be opened such as, in one embodiment, by bleeding down pressure from above the valve to release hydro-static pressure that otherwise holds the valve closed. Optionally, the equalization valve can be opened by mechanical force, that is, by pulling up on the work string and uphole tubular for disabling the valve (see FIG. 5). Thus, the operator can be assured, from surface, that the valve has actually been opened. Once the pressure is equalized, the tool can be moved and damage to the tool or packer is minimized or avoided.

FIG. 1 shows the pressure equalization valve 10 as a component of a work string 100, such as that formed of coiled tubing. The work string comprises slotted treatment sub 102, a diverter nose memory gauge carrier 104, the pair of bottom cups 106 (a straddling and upper pair of opposing cups not shown), a set down J-slot slip and drag block assembly 108, a cone 110 and slips 112, a casing collar locator 114 and a magnetic bar memory gauge carrier 116.

The bore of pressure equalization valve 10 is in fluid communication with the bore running through the work string 100. When the equalization valve is in an "open (or equalization) configuration" fluid can flow through the valve, thus pressure above and below the bottom cups 106 is equal. When the valve is in a "closed (or treatment) configuration" fluid cannot pass through the valve and any injected fluid exits the work string above the equalization valve, for example via ports 118 above the bottom cups 106. An open configuration is used, for example, when running in or pulling out of hole and a closed configuration is used, for example, when performing fluid treatment such as hydraulic fracturing. Herein, the fluid treatment is described in terms of hydraulic fracturing, in which fluid at high pressure is discharged through the slotted treatment sub 102. Other treatments as introduced above are equally applicable.

Figure 1B:
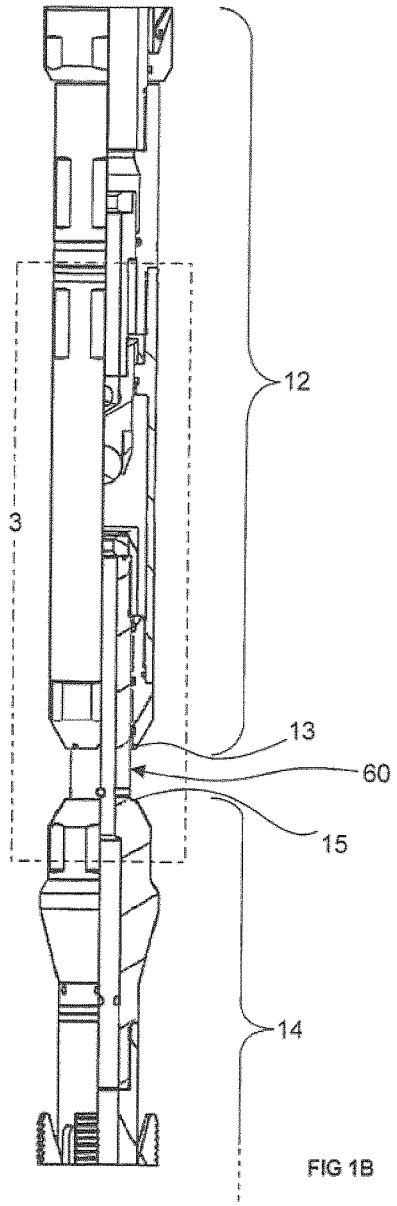
FIG. 1B is an enlarged side partial sectional view of the equalization valve shown in FIG. 1A.

The pressure equalization valve 10 is shown on work string 100 in FIG. 1A, and in more detail in FIG. 1B. It comprises an uphole tubular 12 and a downhole tubular 14, which are telescopically or axially movable relative to each other. In this embodiment, a portion of the downhole tubular 14 extends uphole into the bore of the uphole tubular 12 and is telescopically movable therealong. The downhole tubular 14 can move relative to the uphole tubular 12 and, conversely, the uphole tubular 12 can move relative to the downhole tubular 14. The uphole and downhole tubulars 12, 14 are movable between two delimited configurations.

A first configuration is achieved when the downhole tubular is maximally spaced from the uphole tubular a distance 60, between shoulder/stop 15 of the downhole tubular and shoulder/stop 13 of the uphole tubular 12. In this first configuration the downhole tubular is at its downhole-delimited position. Contact between an internal stop 54 and shoulder 56 between the uphole and downhole tubulars respectively (see FIG. 3A) sets the "downhole-delimited" position of the downhole tubular (shown also for e.g., in FIG. 2A, 3A, 3B, 5F).

A second configuration is achieved when the downhole tubular is minimally spaced from the uphole tubular, such that shoulder 15 of the downhole tubular 14 contacts shoulder 13 of the uphole tubular 12. In this second configuration the downhole tubular is at its uphole-delimited position. Contact of shoulders 15 and 13 sets the "uphole-delimited" position of the downhole tubular (shown also in FIGS. 2B, 2C, 3C, 5A, 5B). Thus, the downhole tubular can move between the uphole- and the downhole-delimited position.

The tubulars 12, 14 are actuated to move axially toward or away from one another by mechanical force. More particularly, when running in hole, friction and drag on the downhole tubular move it axially towards the uphole tubular, towards its uphole-delimited position. When pulling out of hole, friction and drag on the downhole tubular move it away from the uphole tubular, increasing the distance therebetween to maximum distance 60.

When the downhole tool is located and a fluid treatment operation is to be performed, the downhole tubular may be anchored within the wellbore using the set down J-slot slip and drag block assembly 108, which causes the slips 112 to engage the cone 110 and therefore to be disposed radially outwards to contact the casing. Once anchored, the downhole tubular does not move axially along the well bore.

The valve comprises a valve shuttle 18 fit with valve ball 20, and a valve seat 22. The valve shuttle 18 is disposed within the bore of the uphole tubular 12, and is axially movable therealong between two positions: (a) a position in which the valve shuttle is maximally biased uphole, referred to herein as the "uphole-delimited" position of the shuttle (see FIG. 2A, 2B, 3A, 3C, 5A) and (b) a position in which the valve shuttle is moved maximally downhole, referred to herein as the "downhole-delimited" position of the shuttle (see FIG. 3B, 5E). Thus, the shuttle can move, within the uphole tubular, between an uphole- and a downhole-delimited position. In the embodiments shown, cooperation between a shuttle housing in the uphole tubular 12 and the shuttle 18 limits the axial range of movement of the valve shuttle 18.

The valve shuttle 18 is actuable by fluid flow therethrough for axial downhole movement. The rate of fluid flow through the shuttle determines whether the valve shuttle is near or at its uphole- or downhole-delimited position. More particularly, a downhole rate of fluid flow that is below a threshold value, including no flow or uphole flow, is insufficient to overcome the biasing of the valve shuttle, and the valve shuttle will be at its uphole-delimited position. A rate of fluid flow that is greater than a threshold value will overcome the biasing and the valve shuttle will move to or towards its downhole-delimited position.

At a distal (downhole) end of the valve shuttle 18 is a valve ball 20 which can sealably interact with valve seat 22 at the proximal (uphole) end of the downhole tubular 14. When the ball 20 is not seated in the seat 22, a contiguous axial bore is formed between the uphole and downhole tubulars 12 and 14, and a fluid can flow between the bore of the uphole tubular and the bore of the downhole tubular (referred to herein as the open, or equalization, configuration of the valve). When the ball 20 is seated in the seat 22, the fluid can no longer flow between the bore of the uphole tubular and the bore of the downhole tubular (referred to herein as the closed, or treatment, configuration of the valve).

In the equalization valve described herein, when the downhole tubular is at its downhole delimited position a sealing interaction between the ball 20 and seat 22 cannot be achieved, regardless of the position of the valve shuttle (which positions the valve ball). Likewise, when the valve shuttle is at its uphole-delimited position a sealing interaction between the ball 20 and seat 22 cannot be achieved, regardless of the position of the downhole tubular (which positions the valve seat). Thus, in both scenarios, fluid can flow between the bore of the uphole tubular and the bore of the downhole tubular, that is, the valve is in an open configuration. It is only when the downhole tubular and the valve shuttle move away from their respective downhole- and uphole-delimited positions that a sealing interaction may be achieved, as described more fully below. If a sealing interaction occurs, a fluid will not be able to flow from the bore of the uphole tubular into the bore of the downhole tubular, that is, the valve will be in a closed configuration.

As described more fully below, the present equalization valve includes:

a) a flow rate-independent open or equalization configuration: fluid can flow through the valve, regardless of whether the rate of fluid flow is above or below a threshold value;

b) a flow rate-dependent open or equalization configuration: fluid can flow through the valve if the rate of fluid flow is below a threshold value; and c) a flow rate-dependent closed configuration: fluid cannot flow through the valve if the rate of fluid flow is above a threshold value.

When the work string is being pulled out of hole, the downhole tubular is near or at its downhole-delimited position. The valve shuttle is at its uphole-delimited position if the rate of fluid flow is below a threshold, or it is moved to or towards its downhole-delimited position if the rate of fluid flow is above a threshold. But, because the downhole tubular is near or at its downhole-delimited position, the equalization valve cannot be closed when being pulled out of hole, regardless of the rate of fluid flow.

When being run in hole the downhole tubular is near or at its uphole-delimited position. But, fluid flow through the valve maintains the valve shuttle at its uphole-delimited position and therefore the equalization valve cannot be closed when being run in hole. If fluid is added while running in hole, a rate of fluid flow that overcomes the biasing of the valve shuttle will also move the downhole tubular away from the uphole tubular, therefore the valve cannot be closed.

It is to be noted that once the equalization valve has been closed, a reduction in the rate of fluid flow will not result in movement of the valve ball 20 away from valve seat 22 and a subsequent opening of the equalization valve. A hydraulic head of fluid trapped above the valve places a large closing force on the ball against the seat, maintaining the ball in a closed position. Opening of the valve may be achieved either by pulling up on the valve shuttle, which forces the ball 20 off the seat 22, or by bleeding off the pressure above the valve to enable the ball to bias uphole off of the seat.

Figure 2C:
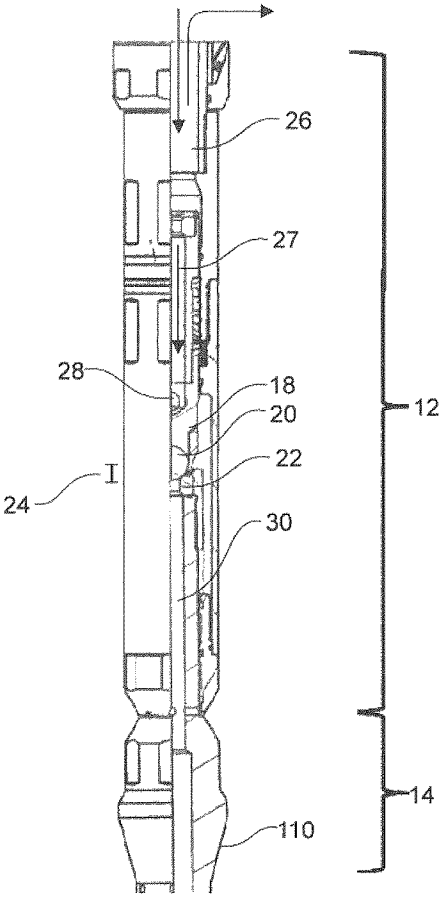
FIGS. 2A to 2C are enlarged partial sectional views that compare three positions of the components of the equalization valve, more particularly.
Figure 2B:
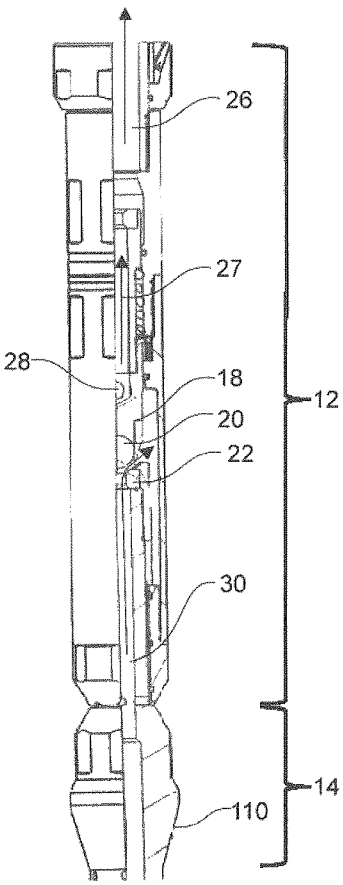
Figure 2A:
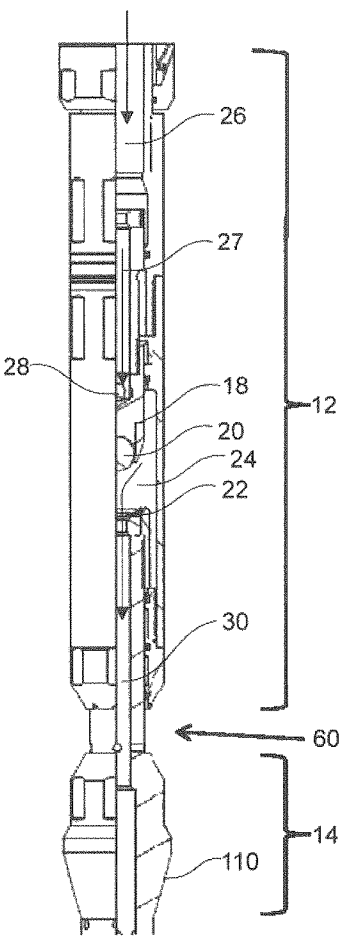

FIGS. 2A to 2C show the equalization valve with the valve shuttle and downhole tubular in three configurations, and the flow of fluid therethrough. FIG. 2A shows the downhole tubular at its downhole-delimited (pulling out of hole) position, that is, the downhole tubular is separated from the uphole tubular by a maximum distance 60. Valve shuttle 18 is at its uphole-delimited position in FIG. 2A, and valve ball 20 and valve seat 22 are therefore separated from one another by a maximum distance 24. Even if valve shuttle 18 is moved to its downhole-delimited position by fluid flow, the ball and seat will still be separated from one another, although it will be by a distance that is smaller than maximum distance 24. Thus, if the downhole tubular is in its downhole-delimited position, it is not possible to seat valve ball 20 in valve seat 22 regardless of whether valve shuttle 18 is in its uphole- or downhole-delimited position (i.e., regardless of the rate of fluid flow).

When pulling out of hole therefore, fluid (shown by arrows) flows down bore 26 of the uphole tubular 12, into the uphole shuttle bore 27 of the valve shuttle 18, through ports 28 in the valve shuttle 18, and into the downhole valve bore 30 of downhole tubular 14.

FIG. 2B shows the downhole tubular at its uphole-delimited (run in hole) position, that is, there is no space between the ends of the uphole and downhole tubulars. Valve shuttle 18 is at its uphole-delimited position (as also shown in FIG. 2A), and therefore valve ball 20 and valve seat 22 remain separated, that is, they are not sealingly engaged. Thus, even when downhole tubular 14 is at its uphole-delimited position, valve ball 20 and valve seat 22 will still be separated if valve shuttle 18 is at its uphole-delimited position. In this configuration therefore, it is not possible to seat valve ball 20 in valve seat 22.

When running in hole therefore, fluid (shown by arrows) flows up bore 30 of the downhole tubular 14, through ports 28 into uphole shuttle bore 27, and then into bore 26 of the uphole tubular 12.

If for some reason the rate of fluid flow were to exceed threshold while running in hole, or before the slips 112 were set, the valve could not be closed. The pressure from a rate of fluid flow that is sufficient to cause the valve shuttle to move to or towards its downhole-delimited position will cause the downhole tubular to move away from the uphole tubular.

FIG. 2C shows the downhole tubular at its uphole-delimited position (with the slips set) and valve shuttle 18 moved to or towards its downhole-delimited position, because the rate of fluid flow has exceeded a threshold. In this configuration, there is no separation between valve ball 20 and valve seat 22, that is, the valve ball is seated in the valve seat.

Injected fluid therefore (shown by arrows) flows down bore 26 of the uphole tubular, into uphole shuttle bore 27, and through ports 28. However, the flow of injected fluid into downhole valve bore 30 is prevented by the seating of valve ball 20 in valve seat 22. Since the fluid flow into the downhole valve bore 30 is blocked, the fluid exits the work string 100 uphole of the equalization valve, for example at ports 118.

Figure 3D:
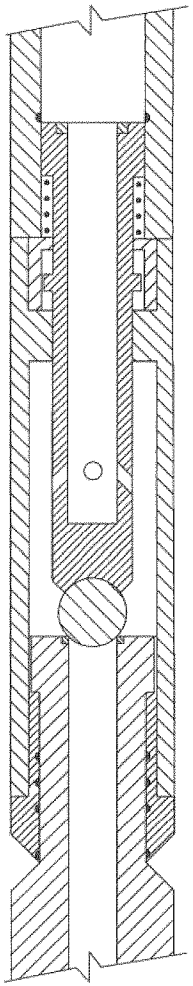
FIGS. 3A to 3D illustrate an enlarged portion of the equalization valve of FIG. 1B showing the detail at the valve shuttle and the valve seat, each figure demonstrating various relative positions of the valve shuttle and valve seat, namely.
Figure 3C:
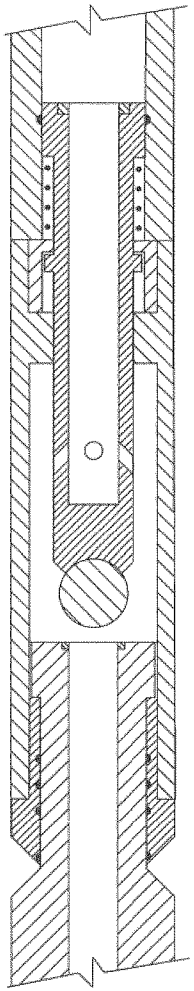
Figure 3B:
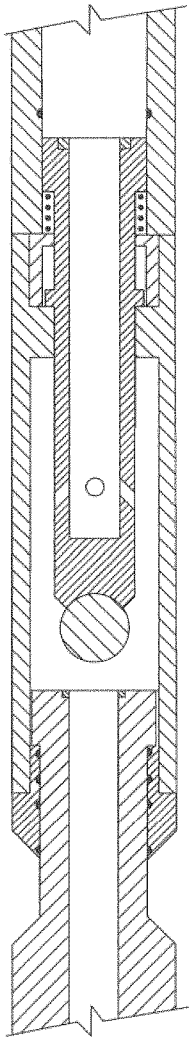
Figure 3A:
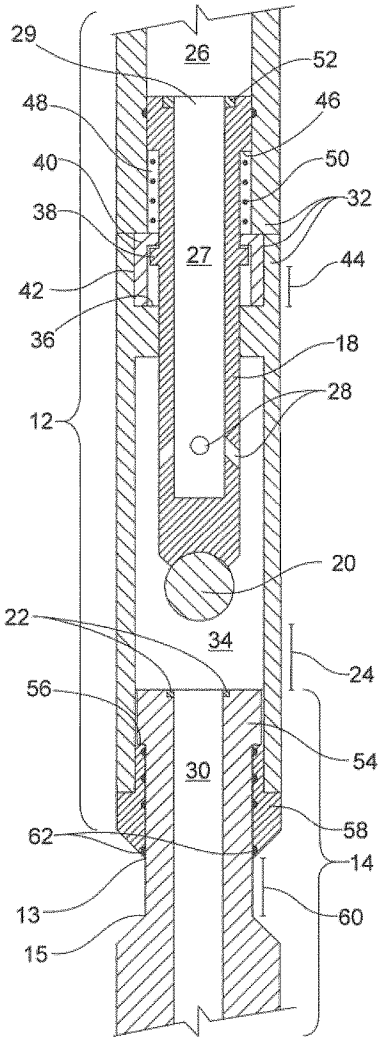

FIGS. 3A to D show detailed cross sections of an embodiment of the valve shuttle and valve seat. Four configurations of the valve shuttle and seat are shown:

a) the downhole tubular is at its downhole-delimited position and the valve shuttle is at its uphole-delimited position (FIG. 3A);

b) the downhole tubular is at its downhole-delimited position and the valve shuttle is at its downhole-delimited position (FIG. 3B);

c) the downhole tubular is at its uphole-delimited position and the valve shuttle is at its uphole-delimited position (FIG. 3C); and d) the downhole tubular is at its uphole delimited position and the valve shuttle has moved towards its downhole-delimited position such that the valve ball engages the valve seat (FIG. 3D).

In this embodiment, uphole tubular 12 comprises a shuttle housing 32, which includes an axial bore within which is disposed valve shuttle 18, which is axially moveable therein. As shown in FIG. 3, the axial bore 34 of the shuttle housing 32 is contiguous with the bore 26 of the treatment tubing.

The valve shuttle 18 includes a bore 27 which includes an inlet 29 in fluid communication with the bore 26 of the treatment tubing and, at its downhole (distal) end, at least one fluid outlet or port 28 that is in fluid communication with the bore 34 of the shuttle housing 32. Valve shuttle 18 comprises at its downhole (distal) end valve ball 20, which can sealingly engage valve seat 22.

In this embodiment, shuttle housing 32 further defines a lower shoulder 36 extending radially inward that defines a stop position for valve shuttle 18 when the shoulder is engaged by stop 38 which extends radially outward from the valve shuttle. Housing 32 further accommodates an adapter 40 that extends radially outward to form an upper shoulder 42 that defines an uphole and stop position for valve shuttle 18, when the shoulder is engaged by stop 38 on the valve shuttle. Thus in this embodiment valve shuttle 18 can move between the lower surface of stop 38 and the upper surface of shoulder 36, and thus the maximum distance that valve ball 20 can move, within the shuttle housing, is distance 44.

In this embodiment valve shuttle 18 further comprises a shoulder 46 that extends radially outward and that together with the upper surface of adapter 40 defines a space 48 within which is disposed a biasing member 50, such as a spring. The spring may be of any spring constant desired, and preloaded to provide a range of thresholds at which the valve shuttle will begin its movement when flow rate is applied. Biasing member 50 biases shuttle 18 uphole until stop 38 engages upper shoulder 42 (see FIGS. 3A and 3C). If the rate of fluid flow into valve shuttle 18 exceeds a threshold rate, then the biasing is overcome and shuttle 18 can move axially downhole, until the ball 20 engages seat 22 or the stop 38 engages lower shoulder 36.

In this embodiment valve shuttle 18 further comprises nozzle 52 at its uphole (proximal) end, the purpose of which is to provide a flow restriction. As fluid passes through nozzle 52, the fluid friction imparts a force on the valve shuttle. In one embodiment, the nozzle 52 is made of a hard (ceramic) material to resist abrasion (which would change the ID of the nozzle) and maintain a consistent threshold flow rate.

In this embodiment, downhole tubular 14 comprises valve seat 22 fit within an axial bore 30 of the downhole tubular at the proximal (uphole) end of the bore. The valve seat delineates an uphole valve bore including housing bore 34 and shuttle bore 27, from downhole valve bore 30. In this embodiment the downhole tubular 14 further comprises a stop 54 which extends radially outward and which engages a shoulder 56 at the end of an adapter 58 disposed at the distal (downhole) end of upper tubular 12. Engagement of stop 54 and shoulder 56 prevents downhole tubular 14 from being pulled out of the bore of the shuttle housing (the downhole-delimited position of the downhole tubular).

In this embodiment, when stop 54 and shoulder 56 are engaged, the uphole and downhole tubulars are spaced maximally apart. Movement of the downhole tubular 14 towards the uphole tubular 12 stops when its proximal shoulder 15 contacts the distal shoulder 13 of the uphole tubular (the uphole-delimited position of the downhole tubular). Thus, the positions of shoulder 56 and shoulder 13 define the maximum distance 60 that valve seat 22 can move.

The downhole tubular further comprises a means for immobilizing the downhole tubular in the wellbore. In the embodiments described herein the means comprises a cone 110 disposed about the periphery of the downhole tubular that engages one or more slips 112 that in turn engage the casing of the wellbore and immobilize the downhole tubular. The slips are actuated by the set down J-slot slip and drag assembly.

FIG. 3A shows the valve shuttle 18 at its uphole-delimited position and the downhole tubular 14 at its downhole-delimited position, defining a maximum distance 24 between valve ball 20 and valve seat 22. If the valve ball moves downwards in the shuttle housing by distance 44, or if the valve seat moves upwards by distance 60, the valve cannot close. It follows, therefore, that distance 24 is greater than either of distance 44 or distance 60.

This is further shown in FIGS. 3B and 3C. FIG. 3B shows the downhole tubular at its downhole-delimited position and the valve shuttle at its downhole-delimited position. Since distance 44 is less than distance 24, the movement of the valve shuttle to its downhole-delimited position is insufficient to close the gap between valve ball 20 and valve seat 22. FIG. 3C shows the downhole tubular in its uphole-delimited position and the valve shuttle in its uphole-delimited position. Since distance 60 is less than distance 24, the movement of the downhole tubular to its uphole-delimited position is insufficient to close the gap between valve ball 20 and valve seal 22.

FIG. 3D shows the downhole tubular 14 at its uphole-delimited position, and the valve shuttle has moved towards the downhole tubular 14 until the valve ball 20 sealingly engages valve seat 22. It follows, therefore, that in order to seat the valve ball in the valve seat, distance 24 must be less than the sum of distance 44 and distance 60. In one embodiment distance 60 is about 1.5 inches, distance 44 is greater than about 0.25 inches and distance 24 is about 1.75 inches.

Figure 4:
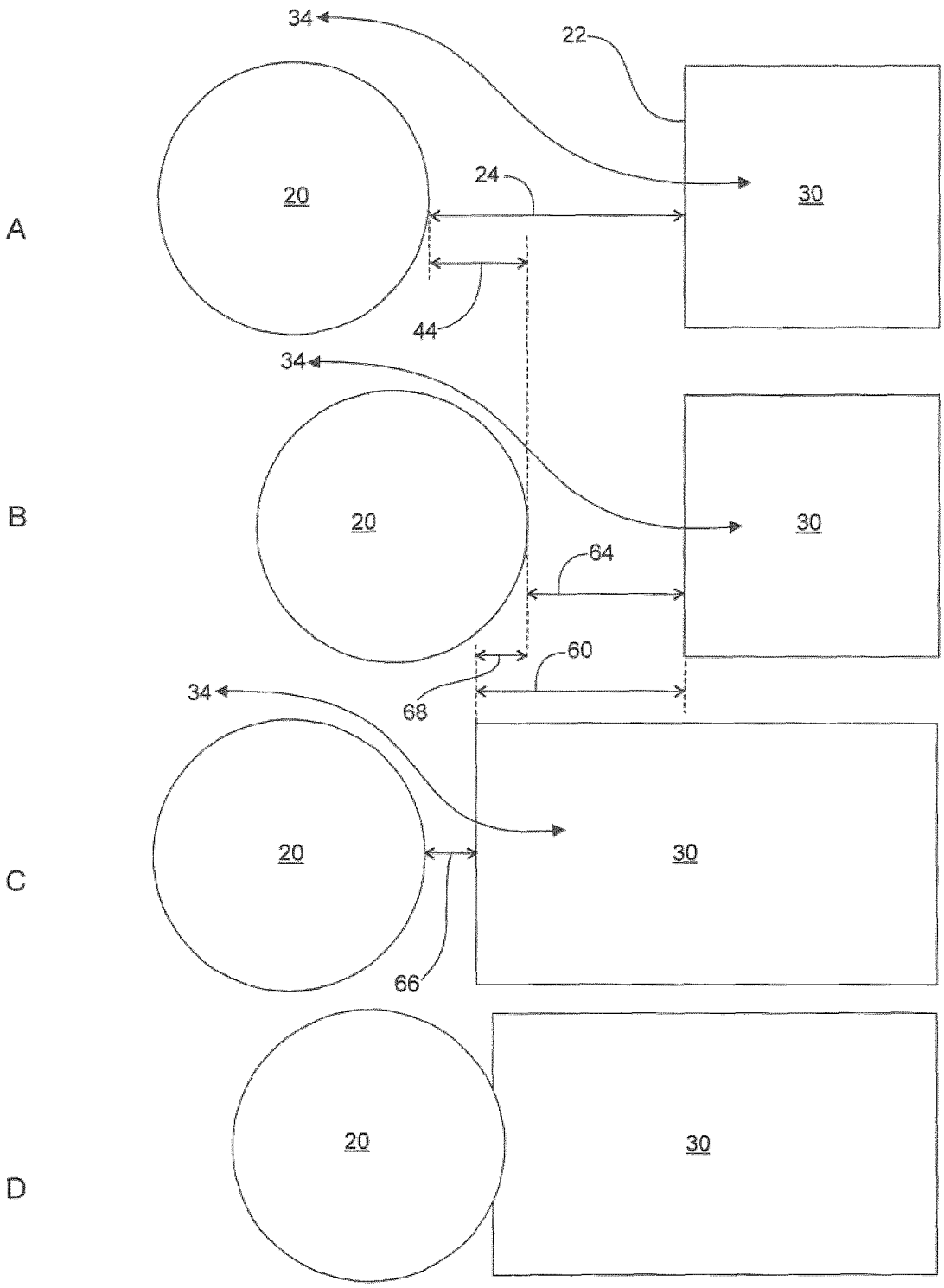
FIGS. 4A to 4D are schematics showing the various limits on movement of the valve ball and valve seat, namely.

FIGS. 4A to 4D demonstrate schematically how maximum distances 44 and 60 may be determined. In the embodiments shown herein, when the downhole tubular 14 is at its downhole-delimited position (as shown in FIG. 4A, 4B), and the shuttle valve is at its uphole-delimited position (FIG. 4A), a maximum distance 24 is defined between valve ball 20 and valve seat 22. To avoid closure of the valve at a flow rate that is greater than the threshold rate, the distance 44 that the shuttle valve/valve ball can travel within the shuttle housing cannot be more than a distance that will maintain a gap 64 that ensures that there is always flow through the valve (FIG. 4B).

Likewise, to avoid closure of the valve when the flow rate is not greater than the threshold rate, the distance 60 that the downhole tubular/valve seat can travel cannot be more than a distance that will maintain a gap 66 that ensures that there is always flow through the valve (FIG. 4C).

The maximum axial distance that valve ball 20 can be moved, distance 44, may therefore be determined by the minimum distance 64 between valve ball 20 and valve seat 22 that will provide a flow passage that is large enough to support the required fluid flow through the equalization valve when it is being pulled out of hole. Likewise, the maximum axial distance that the valve seat can be moved, distance 60, may be determined by the minimum distance 66 between valve ball 20 and valve seat 22 that will provide a flow passage that is large enough to support the required fluid flow through the equalization valve when it is being run in hole. These distances need not be the same.

It is to be further noted, having reference to FIGS. 4A-D, that if the valve seat is moved to any position within the gap distance 64, that is, if the valve seat is moved to a position that is outside of the travel distance 44 of the shuttle valve, the equalization valve will not be able to close, regardless of the fluid flow rate. Therefore, a "valve-disabled" position of the downhole tubular may be defined as a position wherein the downhole tubular is at its downhole-delimited position, or at any position that is outside of the travel distance 44 of the shuttle valve.

Likewise, if the valve ball is moved to any position within the gap distance 66, that is, if the valve ball is moved to a position that is outside of the travel distance 60 of the valve seat, the equalization valve will not be able to close. Therefore, an "uphole-biased" position of valve shuttle may be defined as a position wherein the valve shuttle is at its uphole-delimited position, or at any position that is outside of the travel distance 60 of the downhole tubular.

FIGS. 4A-D (and also 5 A-F) demonstrate further aspects of the valve described herein. In preferred embodiments there is a region of overlap, shown at arrow 68, between the travel distance 44 of the valve ball and the travel distance 60 of the valve seat. Anywhere in this region, it is possible for the valve ball and seat to engage and close the equalization valve. Therefore, a "valve-enabled" position of the downhole tubular may be defined as a position wherein the downhole tubular is at its uphole-delimited position, or at any position in the travel distance 60 of the downhole tubular that overlaps with the travel distance 44 of the shuttle valve. Likewise, a "flow-extended" position of the valve shuttle may be defined as a position wherein the valve shuttle is at its downhole-delimited position, or at any position in the travel distance 44 of the shuttle that overlaps with the travel distance 60 of the downhole tubular. As shown in FIG. 4D, valve can close when the downhole tubular is not at its uphole delimited position, and when the shuttle is not at its downhole delimited position, provided that the seat and ball meet in the region of overlap 68.

Thus, when the downhole tubular in a valve-enabled position, and a) the fluid flow rate is less than a threshold rate, valve shuttle 18 is biased in an uphole-biased position, and fluid can flow between the uphole valve bore and the downhole valve bore (see FIG. 2B, 3C, 5A, 5E, 5F), or b) the fluid flow rate is greater than a threshold rate, valve shuttle 18 is actuated to the flow-extended position to engage seat 22 and close the valve (see FIG. 2C, 3D, 5B-D), preventing the flow of fluid between the uphole valve bore and the downhole valve bore.

When the downhole tubular is at its valve-disabled position, the valve ball 20 cannot sealingly engage valve seat 22 regardless of whether the fluid flow rate is greater than or less than a threshold rate, and thus fluid can flow between the uphole valve bore and the downhole valve bore (FIG. 2A, 3A, 3B).

When the rate of fluid flow is sufficient to cause a sealing engagement between the valve ball 20 and seat 22, a reduction in the rate of fluid flow will not result in movement of the valve ball 20 away from valve seat 22 and a subsequent opening of the equalization valve. Thus, once it is in a closed configuration, the valve will not return to an open configuration simply because the flow rate has been decreased to below the threshold. Breaking the seal can be achieved by either:

(a) pulling up on the equalization valve which will force the seat away from the ball, or (b) stopping the flow of fluid into the equalization valve and bleeding off the pressure at the surface by bleeding off the coiled tubing, or in some cases the casing, to move the ball from the seat.

Figures 5A, 5B, 5C, 5D, 5E, 5F:
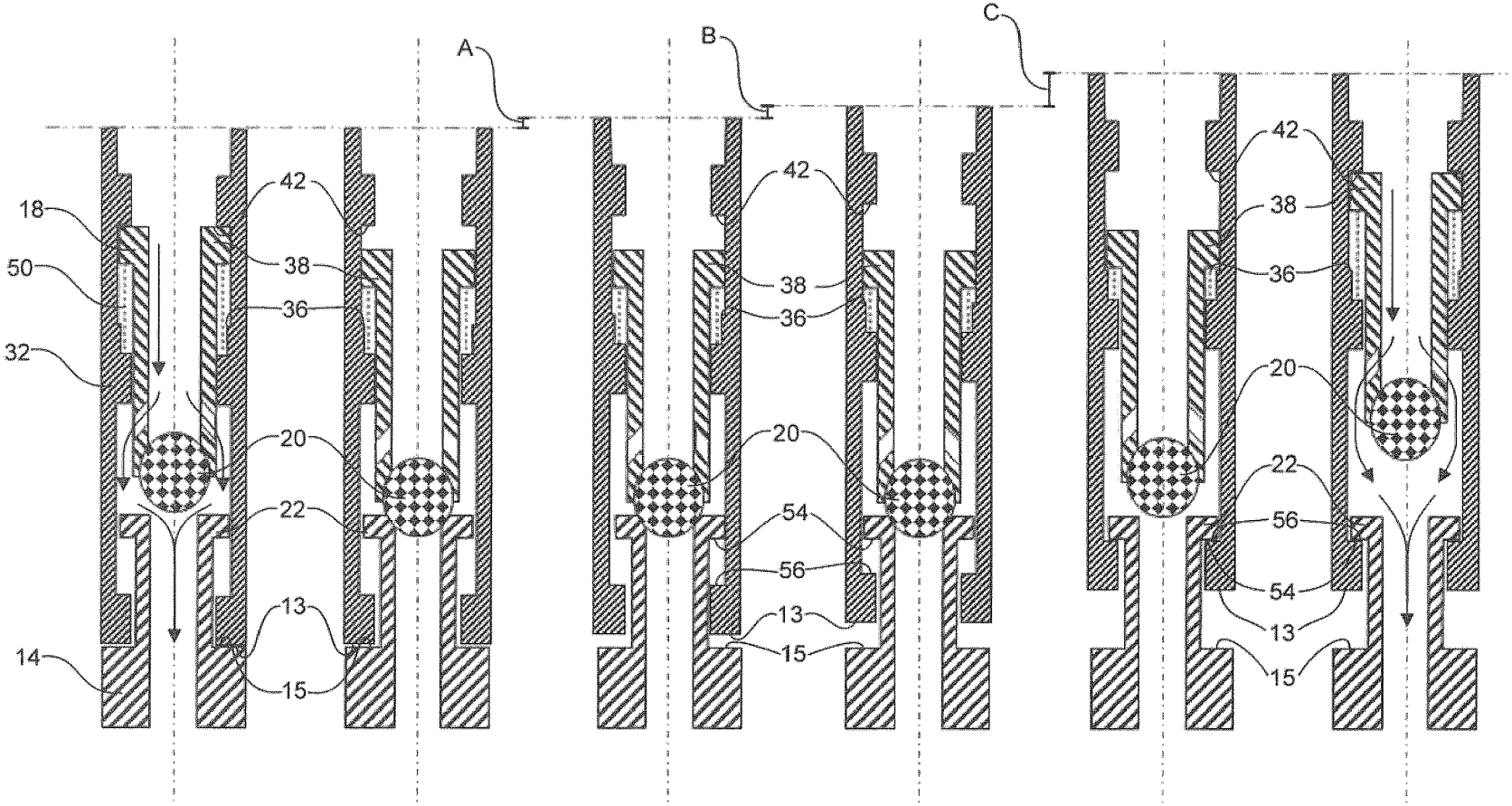
FIGS. 5A through 5F illustrate various stages of operation of the equalization valve, and more particularly of the process of opening the valve after it has been closed.

FIGS. 5A through 5F illustrate the process of opening an embodiment of the equalization valve after it has been closed, by pulling up on the equalization valve. FIG. 5A illustrates the valve in an open configuration. The valve is enabled, with the downhole tubular at a valve-enabled position, that is, shoulder 13 of up hole tubular 12 has engaged the shoulder 15 of downhole tubular 14. Valve shuttle 18 is at an uphole-biased position, that is stop 38 of the shuttle has engaged shoulder 42 of the housing. Fluid flow through the valve is indicated by arrows.

FIG. 5B illustrates the valve in a closed configuration because the valve shuttle has been fluid-forced to a flow-extended position, wherein the valve ball on the shuttle engages the valve seat. In this embodiment, the valve shuttle does not engage the shoulder 36 of the shuttle housing 32; movement of the valve shuttle 18 towards its downhole-delimited position is stopped by engagement of the valve ball 20 with the valve seat 22.

FIGS. 5C to 5E show the steps for opening the valve after the wellbore treatment is completed. The rate of fluid flow into the valve is reduced to below a threshold value, however as noted above the valve shuttle will remain biased downhole. In FIG. 5C, as compared to FIG. 5B, an operator at surface has pulled up on the upper tubular by increment A. The valve ball 20 remains sealingly engaged in the valve seat 22, and the shuttle housing 32 shifts against the biasing.

FIG. 5D as compared to FIG. 5C, an operator at surface has pulled up on the upper tubular by further increment B. Again, the valve ball 20 remains sealingly engaged in the valve seat 22, and the shuttle housing 32 shifts against the biasing.

FIG. 5E as compared to FIG. 5D, an operator at surface has pulled up on the upper tubular by further increment C. Again, the shuttle housing 32 shifts against the biasing, but this time stop 38 on shuttle 18 engages shoulder 36 of shuttle housing lifting the valve ball from the valve seat to open and equalize across the valve.

Because fluid flow is below threshold, biasing returns valve shuttle 18 to an uphole-biased position until stop 38 engages shoulder 42. At the same time, or subsequently, stop 54 of downhole tubular engages shoulder 56 on the uphole tubular, to limit the uphole movement of the valve housing. FIG. 5F illustrates the valve in an open configuration with maximum fluid flow downhole therethrough.

In one embodiment, a flow rate of more than 200 L/min is the threshold flow rate that will overcome the biasing of the valve shuttle 18. If the downhole tubular is also in its valve-enabled position and immobilized in the wellbore (e.g., by setting the slips), the equalization valve will close. Reducing the flow rate to less than 200 L/min does not open the valve.

If the downhole tubular is not immobilized in the wellbore, the equalization valve will not be able to close even if the flow rate is greater than the threshold rate, which in one embodiment is 200 L/min.

The uphole tubular 12 may be sealably connected to the downhole tubular 14. FIG. 3A shows seals 62 in corresponding grooves at the distal end of adapter 58. When the equalization valve is used downhole of the packer or other sealing element, the uphole tubular 12 and downhole tubular 14 are preferably sealably connected. However, when the equalization valve is used uphole of the packer or other sealing element, the uphole tubular 12 and downhole tubular 14 may not be sealably connected. In one embodiment the seals are made of an elastomeric material. However the seals may be made from any material suitable for the sealing of pressure.

The insertion and removal of the valve and work string into a wellbore will now be described in further detail. FIGS.

6A-C show flow charts illustrating the steps of operation that remain possible during run in, pulling out of hole, and treatment.

Figure 6A:
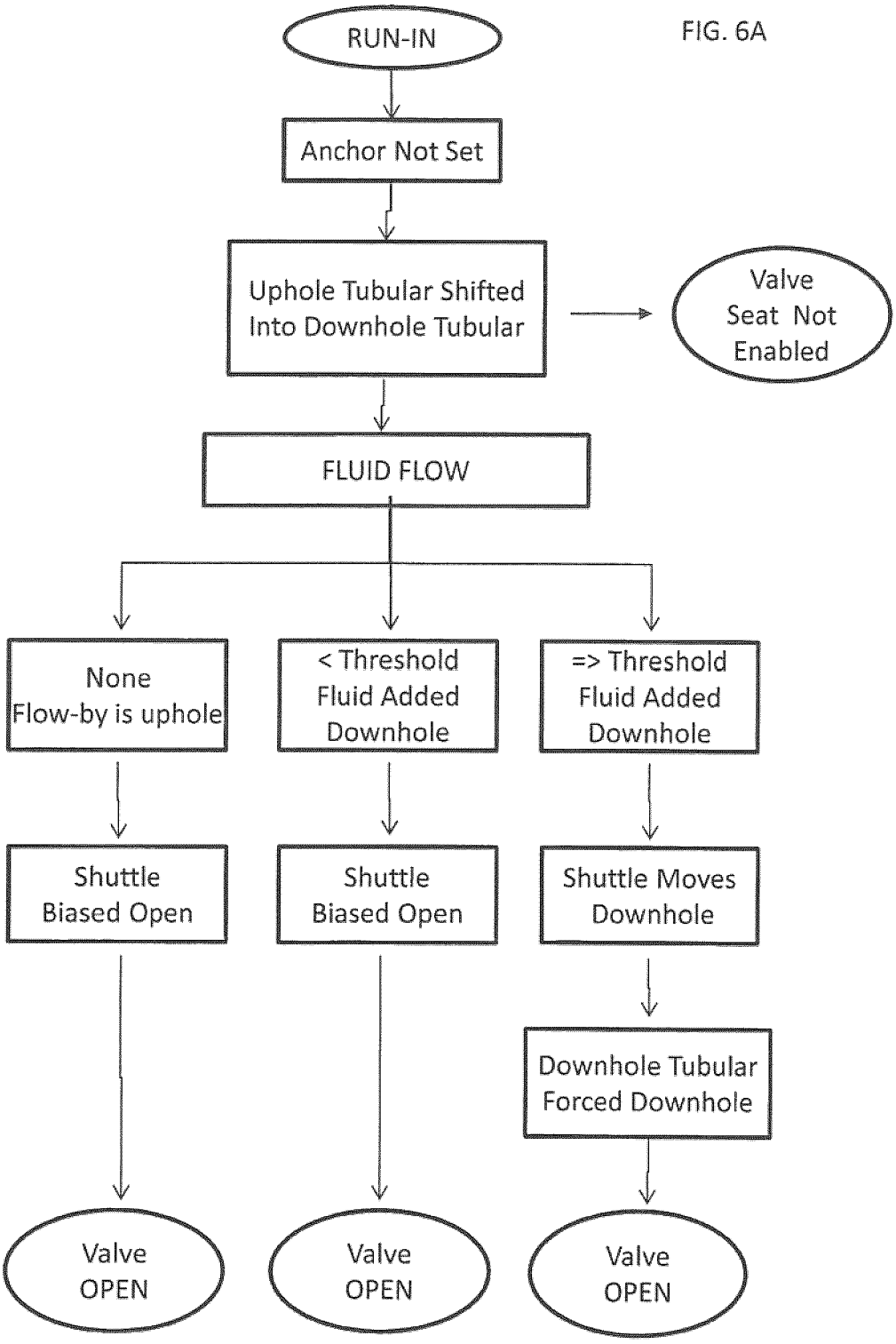
FIGS. 6A to 6C illustrate the steps of operation of the equalization valve, during run into hole, treatment and pulling out of hole, more particularly.

When the work string 100 is run in hole (FIG. 6A), downhole tubular is freely movable axially within upper tubular. Friction and drag will cause the downhole tubular to move towards the uphole tubular to its valve-enabled position, however because the downhole tubular is not set in the wellbore, the valve cannot be closed. Because wellbore fluid is flowing upwards during run in, the valve shuttle is biased upwards and therefore valve ball and valve seat cannot sealingly engage. Thus, while running in hole, without any added injection fluid (left-side path of FIG. 6A), the equalization valve remains in an open configuration because fluid flow biases the valve shuttle uphole. If there is an injection of fluid at a rate that is insufficient to bias valve shuttle to it a flow-extended position (middle path of FIG. 6A), the equalization valve remains open.

If there is fluid injection at a rate sufficient to bias valve shuttle to a flow-extended position, the equalization valve will not close because slips 112 have not fully engaged cone 110 and therefore the wellbore casing. The pressure from the flow of fluid that is needed to overcome the biasing of valve shuttle will force the downhole tubular away from the uphole tubular. Thus, the equalization valve remains in an open configuration because even though there is sufficient fluid flow to bias the valve shuttle towards valve seat, the downhole tubular does not remain in its valve-enabled position.

Figure 6B:
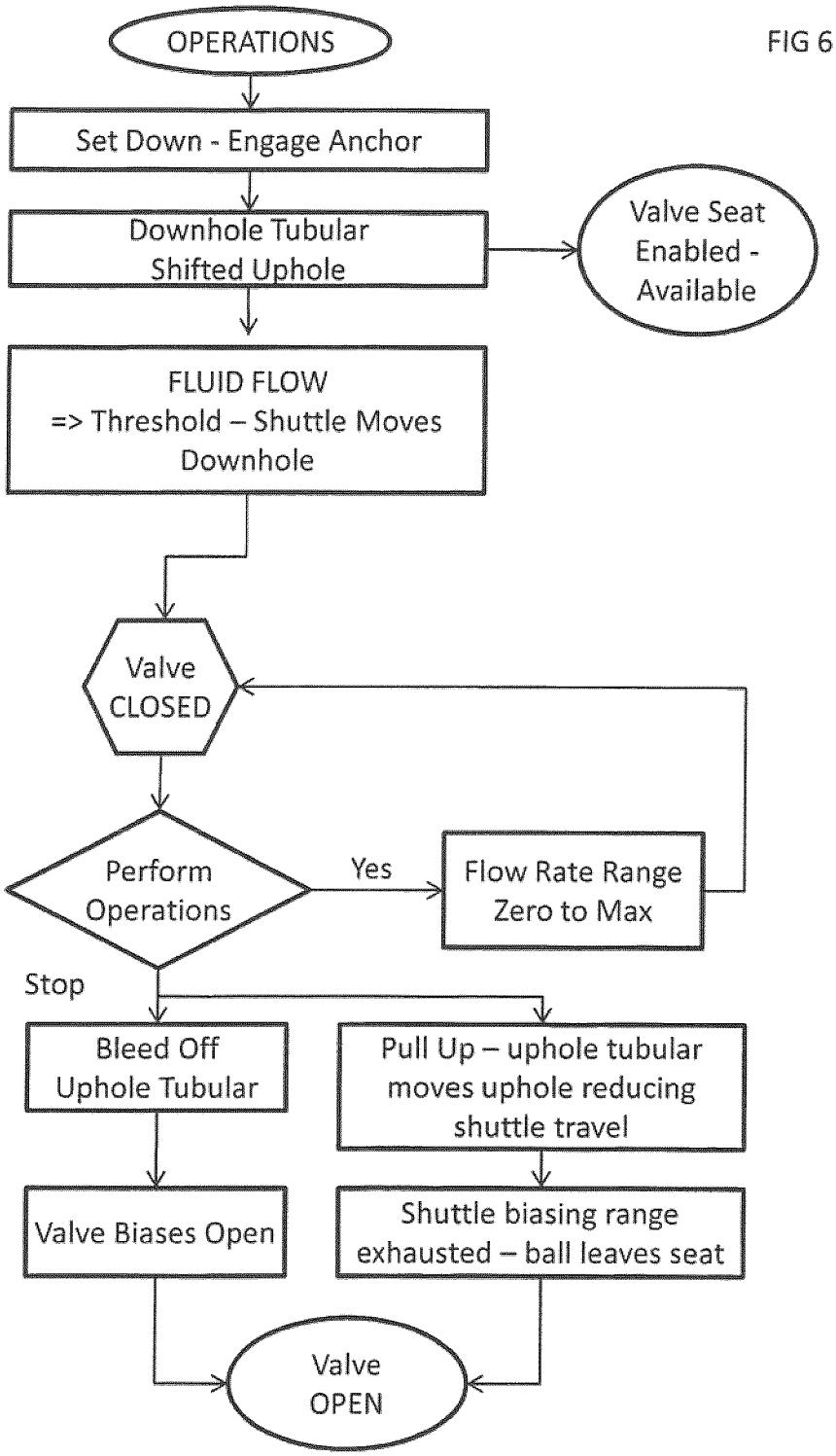

When desired to perform a treatment operation that requires the valve to be in a closed configuration (FIG. 6B), the J-slot slip and drag assembly is actuated to cause the slips to engage the cone and the wellbore casing. The downhole tubular, and hence valve seat, are now immobilized in the bore of the wellbore. The uphole tubular may then be pushed down to ensure that the space between the tubulars is closed or nearly closed (i.e., the downhole tubular is in a valve-enabled position). If fluid flow into the work string is started, and it is below the threshold, the valve shuttle will remain biased uphole and the equalization valve will be in an open configuration allowing the fluid to flow through it. If the flow of fluid is above the threshold, the valve shuttle will be biased towards its downhole-delimited position until the valve ball engages the valve seat, at which time the valve is closed and treatment, for example fracking, can begin. Thus, when the tool string is set down, the attainment of a closed configuration of the equalization valve is flow-rate dependent.

Before work string 100 is pulled out of hole, it is preferable to equalize pressure above and below the valve. This may be accomplished in one of two ways. The operator can pull up on the work string, which will force the valve ball away from valve seat, thus opening the equalization valve. Or, the pressure above the valve may be bled off and biasing will then cause valve shuttle to move uphole, which will unseat valve ball.

Figure 6C:
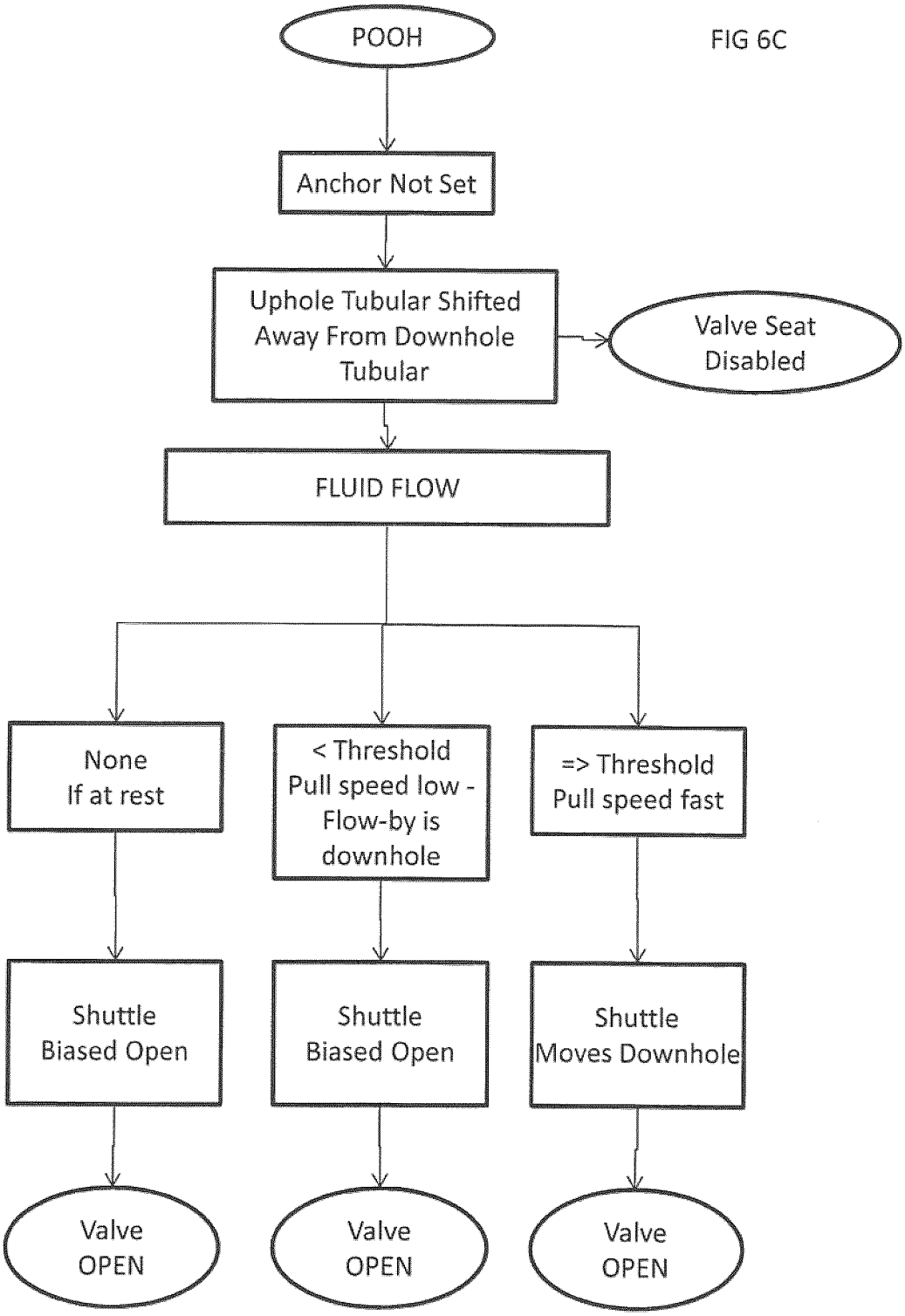

When the work string is being pulled out of hole (FIG. 6C), lower tubular is again freely movable axially along upper tubular. Friction and drag will cause the downhole tubular to move away from the uphole tubular, thus increasing the distance between the ends of these tubulars—the downhole tubular will move to a valve-disabled position. When pulling out of hole, fluid flow through the valve is oriented downhole. However, regardless of whether this fluid flow overcomes the uphole biasing of the valve shuttle, the downhole tubular is in a valve-disabled position. Thus, while pulling out of hole it is not possible to close the equalization valve.

While the equalization valve has been described in conjunction with the disclosed embodiments and examples which are set forth in detail, it should be understood that this is by illustration only and the equalization valve is not intended to be limited to these embodiments and examples. On the contrary, this disclosure is intended to cover alternatives, modifications, and equivalents which will become apparent to those skilled in the art in view of this disclosure.

The invention claimed is:

1. A pressure equalization valve comprising:

a downhole tubular telescopically coupled for axial movement relative to an uphole tubular and forming a contiguous axial bore therethrough, the downhole tubular delimited for axial movement towards the uphole tubular at an uphole-delimited position and delimited for axial movement away from the uphole tubular at a downhole-delimited position;

a valve seat fit within the axial bore of the downhole tubular for defining an uphole valve bore and a downhole valve bore in fluid communication therethrough;

a valve ball coupled to a valve shuttle, the valve shuttle disposed in the bore of the uphole tubular and axially movable therein, the shuttle biased uphole to an uphole-biased position, and being actuable towards a downhole-delimited position by fluid flow through the uphole valve bore; and wherein the downhole tubular is actuable from the downhole-delimited position to a valve-enabled position wherein, when the downhole tubular is in the valve-enabled position and when fluid flow through the uphole valve bore is greater than a threshold flow rate, the valve ball engages the valve seat;

wherein when the downhole tubular is in the valve-enabled position:

fluid flow greater than the threshold flow rate overcomes the biasing to move the shuttle from the uphole-biased position to a flow-extended position at which the valve ball engages the valve seat to isolate the uphole valve bore from the downhole valve bore, and fluid flow less than the threshold flow rate maintains the shuttle biased in the uphole-biased position for continued fluid communication between the uphole valve bore and the downhole valve bore; and wherein when the downhole tubular is not in the valve-enabled position, the valve ball is spaced from the valve seat so that when the shuttle is in the flow-actuated position the valve ball remains spaced from the valve seat for continued fluid communication between the uphole valve bore and the downhole valve bore.

2. The valve of claim 1 wherein the valve shuttle has a fluid inlet in fluid communication with the uphole valve bore, and a flow-diverting fluid outlet in fluid communication with the uphole valve bore, and fluid flow through the shuttle's fluid inlet and fluid outlet urges the shuttle downhole against resistance of the biasing.

3. The valve of claim 1 further comprising an anchor assembly coupled to the downhole tubular and configured to immobilize the downhole tubular with respect to a wellbore;

wherein the downhole tubular is actuable to a valve-enabled position while the downhole tubular is immobilized with respect to the wellbore by the anchor assembly.

4. The valve of claim 3 wherein the anchor assembly comprises a slip.

5. The valve of claim 1 wherein the valve seat is fit at an end of the bore of the downhole tubular.

6. The valve of claim 1 wherein the downhole tubular moves axially within the bore of the uphole tubular.

7. The valve of claim 1 wherein the valve-enabled position of the downhole tubular is the uphole-delimited position of the downhole tubular.

8. The valve of claim 1 wherein the uphole biased position of the shuttle is an uphole-delimited position of the shuttle.

9. The valve of claim 1 wherein at the uphole-delimited position of the downhole tubular, a shoulder on the downhole tubular engages the uphole tubular; and wherein at the downhole-delimited position of the downhole tubular, a stop on the downhole tubular engages the uphole tubular.

10. A pressure equalization valve for a downhole tool, the valve comprising:

an uphole tubular and a downhole tubular telescopically coupled and forming a contiguous axial bore therethrough; the downhole tubular being actuable for axial movement towards the uphole tubular to a valve-enabled position and away from the uphole tubular to a valve-disabled position;

a valve seat fit within the axial bore of the downhole tubular for defining an uphole valve bore and a downhole valve bore in fluid communication therethrough; and a valve shuttle disposed in the bore of the uphole tubular and axially movable therein, the shuttle biased uphole to an uphole-biased position, and being actuable towards a flow-activated position by fluid flow that is greater than a threshold flow rate; and an anchor assembly configured to engage a wellbore to immobilize the downhole tubular relative to the wellbore;

wherein:

when the downhole tubular is in the valve-disabled position and the shuttle is in the flow-actuated position, the valve is open, for continued fluid communication between the uphole valve bore and the downhole valve bore;

when the downhole tubular is in the valve-enabled position and the shuttle is in the uphole-biased position, the valve is open, for continued fluid communication between the uphole valve bore and the downhole valve bore; and when the downhole tubular is immobilized relative to the wellbore and is in the valve-enabled position, and the shuttle is in the flow-actuated position, the valve is closed to fluid communication between the uphole valve bore and the downhole valve bore.

11. The valve of claim 10 wherein fluid flow through the uphole valve bore and into the downhole valve bore urges the shuttle downhole against resistance of the biasing.

12. The valve of claim 11 wherein the fluid flow through the uphole valve bore comprises the flow of fluid into a fluid inlet of the valve shuttle that is in fluid communication with the uphole valve bore, and out of a fluid outlet that is in fluid communication with the uphole valve bore.

13. The valve of claim 10, wherein the anchor assembly includes a slip.

14. The valve of claim 10 wherein the valve seat is fit at an end of the bore of the downhole tubular.

15. The valve of claim 10 wherein the downhole tubular moves axially within the bore of the uphole tubular.

16. The valve of claim 10 wherein the valve-enabled position of the downhole tubular is an uphole-delimited position of the downhole tubular.

17. The valve of claim 10 wherein the valve-disabled position of the downhole tubular is a downhole-delimited position of the downhole tubular.

18. The valve of claim 10 wherein the uphole biased position of the shuttle is an uphole-delimited position of the shuttle.

19. A pressure equalization valve for a downhole tool, the pressure equalization valve comprising:

an uphole tubular having a first shoulder and a downhole tubular having a second shoulder, the uphole and downhole tubulars being telescopically coupled and forming a contiguous axial bore therethrough;

a valve seat disposed within the axial bore of the downhole tubular; and a valve coupled to a valve shuttle, the valve shuttle disposed in the bore of the uphole tubular and axially movable therein, the shuttle biased to an uphole position relative to the uphole tubular and being actuable towards a downhole position relative to the uphole tubular by fluid flow that is greater than a threshold flow rate; and an anchor assembly configured to engage a wellbore to immobilize the downhole tubular relative to the wellbore;

wherein the uphole tubular is actuable for axial movement away from the downhole tubular to achieve a first distance between the first and second shoulders and being actuable for axial movement toward the downhole tubular to achieve a second distance between the first and second shoulders, the second distance being less than the first distance;

wherein the pressure equalization valve comprises:

a first configuration in which the uphole tubular is spaced from the downhole tubular by the first distance, and the valve shuttle is in its uphole position relative to the uphole tubular;

a second configuration in which the uphole tubular is spaced from the downhole tubular by the first distance, and the valve shuttle is in its downhole position relative to the uphole tubular;

a third configuration in which the downhole tubular is immobilized relative to a wellbore by the anchor assembly, the uphole tubular is spaced from the downhole tubular by the second distance, and the valve shuttle is in its uphole position relative to the uphole tubular; and a fourth configuration in which the downhole tubular is immobilized relative to a wellbore by the anchor assembly, the uphole tubular is spaced from the downhole tubular by the second distance, the valve shuttle is in its downhole position relative to the uphole tubular, and the valve engages the valve seat; and wherein the first and second configurations include a valve-disabled position of the downhole tubular relative to the uphole tubular, wherein valve-disabled position does not allow the valve to engage the valve seat.

20. The valve of claim 19 wherein the third and fourth configurations include a valve-enabled position of the downhole tubular relative to the uphole tubular, wherein the valve-enabled position allows the valve to engage the valve seat; and wherein when the downhole tubular is immobilized relative to the wellbore by the anchor assembly, the uphole tubular is actuable to change the downhole tubular from the valve-disabled position to the valve-enabled position and is actuable to change the downhole tubular from the valve-enabled position to the valve-disabled position.

* * * * *